US005544498A

United States Patent [19]

Benedict

[11] Patent Number: 5,544,498

[45] Date of Patent: Aug. 13, 1996

[54] EFFICIENY COOLING FLUID CIRCUIT

[75] Inventor: Olusegun O. Benedict, Les Ulis, France

[73] Assignee: Valeo Thermique Habitacle, Saint-Denis, France

[21] Appl. No.: 236,396

[22] Filed: May 2, 1994

[30] Foreign Application Priority Data

May 6, 1993 [FR] France ..... 93 05456

[51] Int. Cl.[6] ..... F28D 7/02; F25B 41/00

[52] U.S. Cl. ..... 62/513; 165/164; 165/DIG. 395

[58] Field of Search ..... 62/513, 113, 527; 165/164, DIG. 395

[56] References Cited

U.S. PATENT DOCUMENTS

| | | | |
|---|---|---|---|
| 2,272,093 | 2/1942 | McCormack | 62/513 |
| 2,797,554 | 7/1957 | Donovan | 62/513 |
| 3,177,680 | 4/1965 | Rasovich et al. | 62/471 |
| 3,473,348 | 10/1969 | Bottum | 62/513 |
| 3,809,154 | 5/1974 | Heller et al. | 165/105 |
| 4,468,054 | 8/1984 | Orth | 285/137 R |
| 4,756,166 | 7/1988 | Tomasov | 62/474 X |
| 4,867,231 | 9/1989 | Bottum | 165/104.21 |
| 5,103,899 | 4/1992 | Kalina | 165/104.13 |

FOREIGN PATENT DOCUMENTS

| | | |
|---|---|---|
| 0629414 | 7/1927 | France . |
| 0763456 | 2/1934 | France . |
| 0964508 | 4/1950 | France . |
| 2134322 | 12/1972 | France . |
| 2642152 | 1/1990 | France . |
| 2535483 | 11/1993 | France . |
| 2753483 | 6/1979 | Germany . |
| 57-142488 | 3/1982 | Japan . |
| 2228560 | 1/1990 | United Kingdom . |

*Primary Examiner*—William E. Wayner
*Attorney, Agent, or Firm*—Morgan & Finnegan, LLP

[57] ABSTRACT

In a cooling fluid circuit comprising a compressor, a condenser, an expansion valve and an evaporator, a heat exchanger is provided to transfer heat from the duct arriving at the expansion valve to the duct arriving at the compressor, so as to condense the residual vapor and/or to vaporize the residual liquid respectively which may be found therein. The fluid reaching the expansion valve and the fluid reaching the compressor are thus practically free from a vapor phase and liquid phase respectively, which improves the operation of the device. The invention is particularly applicable to the air-conditioning of the passenger space of motor vehicles.

8 Claims, 2 Drawing Sheets

EFFICIENY COOLING FLUID CIRCUIT

BACKGROUND OF THE INVENTION

The invention relates to a cooling fluid circuit comprising a compressor to bring the fluid in vapour phase from a low pressure to a high pressure, a condenser to bring the high-pressure fluid from the vapour phase to the liquid phase by yielding heat to an external medium, an expansion valve to bring the fluid in liquid phase from high pressure to low pressure, an evaporator to bring the low-pressure fluid from the liquid phase to the vapour phase by receiving heat from an external medium, and first, second, third and fourth ducts to transfer the fluid from the compressor to the condenser, from the condenser to the expansion valve, from the expansion valve to the evaporator and from the evaporator to the compressor respectively.

Fluid circuits of this kind are used in particular in air-conditioning installations for the passenger space of motor vehicles.

In such a circuit, the efficiency of the condenser and of the evaporator is imperfect. The fluid leaving the condenser contains a large fraction of vapour, and that leaving the evaporator contains liquid residue. These imperfections in turn are detrimental to the operation of the expansion valve and of the compressor. The presence of vapour in the fluid arriving at the expansion valve involves a loss of efficiency. The presence of liquid in the fluid arriving at the compressor causes phenomena called liquid and oil knocks.

SUMMARY OF THE INVENTION

The object of the invention is to remove these drawbacks.

More particularly, the invention relates to a circuit of the kind defined in the introduction, and comprises the use of a heat exchanger to transfer heat from the second duct to the fourth duct, outside the circuit, so as to condense the residual vapour and/or to vaporise the residual liquid which may be found respectively therein.

The invention makes use of the heating of the fluid caused by its compression in the compressor, as a result of which the temperature of the fluid circulating in the second duct is greater than that of the fluid circulating in the fourth duct. The fluid of the second duct therefore constitutes a warm source which may provide heat, by undergoing a complementary condensation, and that of the fourth duct constitutes a cold source which may collect this same heat by undergoing a complementary vaporisation.

The invention produces an improvement in the rate of heat release by the condenser and/or absorbed by the evaporator, all things otherwise being equal, and therefore enables the components of the air-conditioning device to have smaller dimensions in comparison with known circuits.

Other characteristics, whether complementary or alternative, of the invention, are given below:

The heat exchanger comprises a housing defining a high-pressure chamber and a low-pressure chamber into which the second and fourth ducts respectively open, upstream and downstream, and containing means for transmitting heat from one to the other by conduction and/or by convection.

The means comprise two blocks of fins disposed respectively in said chambers, the fins of each block extending in the direction of flow of the cooling fluid in the corresponding chamber.

Each of the second and fourth ducts opens into two free spaces in the corresponding chamber situated upstream and downstream respectively from the block of fins.

The means comprise a tank containing a fluid which can pass from the liquid to the vapour phase, the tank being adjacent to the two chambers and in thermal contact therewith.

The heat exchanger comprises means for transmitting heat from the second to the fourth duct and vice versa by conduction and/or by convection.

The means comprise at least one block of fins, through the fins of which the second and fourth ducts pass with thermal contact.

The means comprise a tank containing a fluid which can pass from the liquid phase to the vapour phase, the tank being in thermal contact with the second and fourth ducts.

The tank is in thermal contact with the ducts by means of at least one block of fins.

The tank is formed by the housing, which contains a single block of fins through which two ducts pass and in contact with the fluid.

The cooling fluid flows through the heat exchanger, into the two chambers or into the second and fourth ducts, along parallel and oppositely directed routes.

The route of the low-pressure cooling fluid is situated above the route of the high-pressure cooling fluid.

The heat exchanger is thermally insulated.

the expansion valve is of the H-shaped monobloc type and through it passes the fourth duct, upstream from the heat exchanger.

The heat exchanger and the expansion valve form a rigid unit.

DESCRIPTION OF THE DRAWINGS

The characteristics and advantages of the invention will be explained in further detail in the following description, with reference to the attached drawings, in which.

DETAILED DESCRIPTION OF THE PREFERRED EMBODIMENTS

Figure 1:
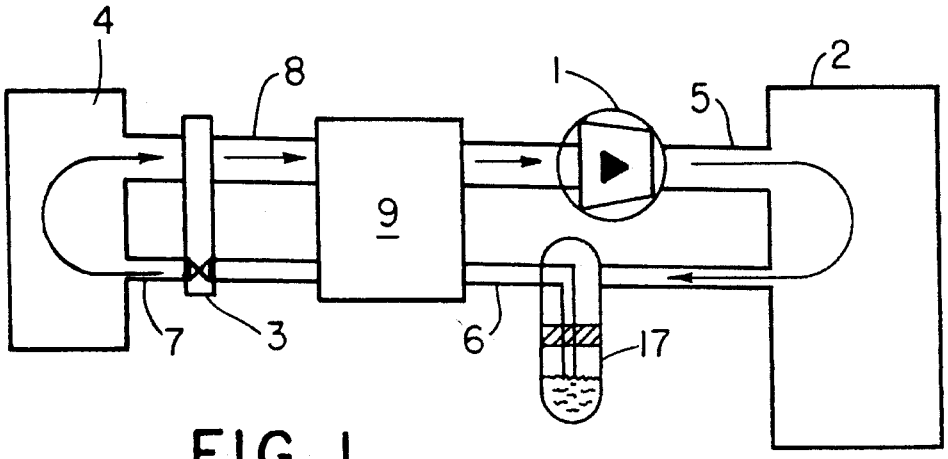
FIG. 1 is a diagrammatical representation of a cooling fluid circuit according to the invention.

The circuit illustrated in FIG. 1 includes a compressor 1, a condenser 2, an expansion valve 3 and an evaporator interconnected by first, second, third and fourth ducts 5, 6, 7, 8. A-cylinder/dehumidifier 17 is located in on duct 6. Condenser 2 and evaporator 4 are situated at the left and right ends respectively of the Figure. Ducts 6 and 7 are disposed in the extension of one another along a first horizontal line, the fluid flowing from right to left. The ducts 8 and 5 are located in the extension of one another along a second horizontal line, above the first horizontal line, the fluid flowing from left to right. The expansion valve 3 is of the type known as a monobloc expansion valve or H-shaped expansion valve and through it passes duct 8. In a known manner, the pressure of the fluid at the outlet of the evaporator can be regulated by detecting this pressure in duct 8 to modulate the expansion action.

According to the invention, the duct 6, between the cylinder/dehumidifier 17 and the expansion valve 3, and the duct 8, between the passage of the expansion valve and the compressor, are interrupted by a heat exchanger 9 contained in a housing 11, here having the shape of a parallelepiped.

A tank 12 extends from one end of the housing 11 to the other, in the longitudinal direction of ducts 6 and 8, and occupies the median part of the height and a median part of the width of the housing. Two partitions 20 oriented longitudinally connect the lateral walls of the tank 12 to those of the housing 11, thus delimiting therein a lower chamber 21 and an upper chamber 22. Chamber 21 has an upstream aperture 23 and a downstream aperture 24, through which duct 6 opens on the side of the condenser 2 and on the side of the expansion valve 3 respectively. Chamber 22 communicates by an upstream aperture 25 and a downstream aperture 26 with duct 8, on the side of the evaporator 4 and on the side of the compressor 1 respectively. Two blocks of fins 27, 28 are housed respectively in chambers 21 and 22, each being formed by a multiplicity of fins or metal plates disposed along vertical planes parallel to the direction of flow of the fluid in the chambers, which corresponds to the direction of ducts 6 and 8. Each fin extends from the top to the bottom of the corresponding chamber, over a median portion of the length of the housing 11, leaving free distributing spaces 29, 30 communicating with the upstream apertures 23, 25 respectively, and free collecting spaces 31, 32 communicating with the downstream apertures 24, 26 respectively. The cooling fluid therefore flows from the distributor 29 to the collector 31 by scavenging the fins of block 27, and from the distributor 30 to the collector 32 by scavenging those of block 28. The tank 12 contains a fluid 13 which is partially in liquid phase and partially in vapour phase. The walls of the tank 12 and the partitions 20 are in direct contact with the fins of blocks 27 and 28. The latter, by conduction, and the fluid 13, by convection and/or by vaporisation/condensation, participate in the transfer of heat from the fluid contained in the chamber 21 to that contained in the chamber 22.

As a refinement, the tank 12 may be widened over the entire width of the housing 11, and may thus be in contact with all the fins of the two blocks, the partitions 20 being omitted.

In another refinement, the tank 12 is omitted, the transfer of heat between the two ducts being performed exclusively by the fins.

The housing 11 of the heat exchanger 9 is surrounded by a thermally insulating shell 15, for example made from synthetic foam.

Figure 3:
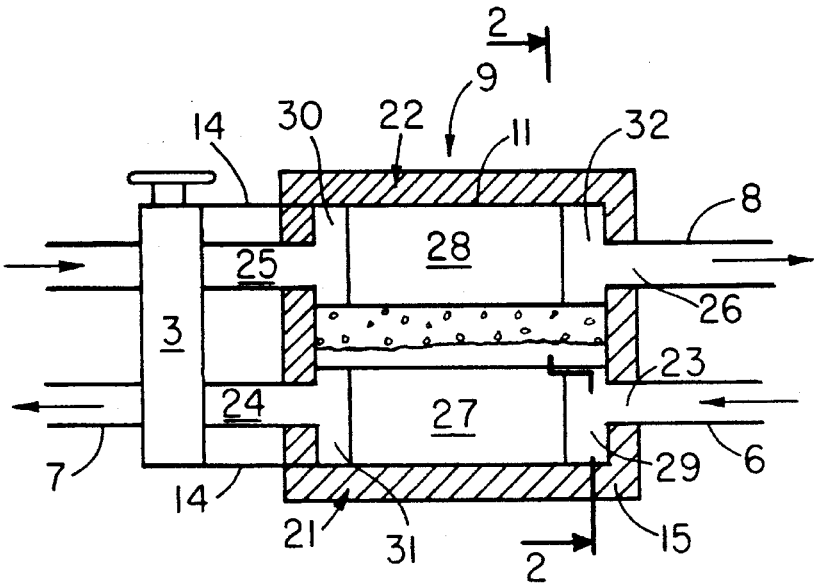
FIG. 3 is a partial view of the circuit, the heat exchanger being represented in longitudinal section.

FIG. 3 shows the rigid unit formed by the heat exchanger 9 and the expansion valve 3 illustrated diagrammatically in FIG. 1, interconnected by stiffening elements shown diagrammatically under reference 14.

Figure 2:
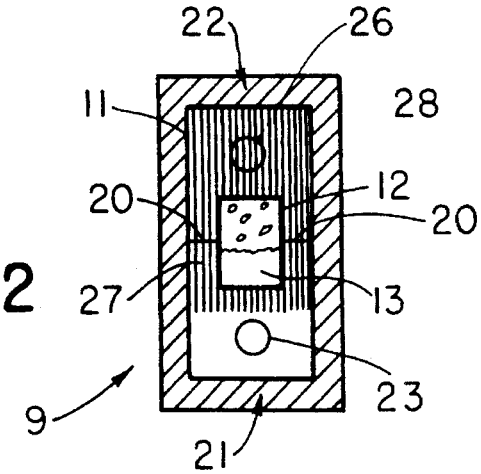
FIG. 2 is a cross-sectional view, along line II—II of FIG. 3, of the heat exchanger of the circuit in FIG. 1.
Figure 4:
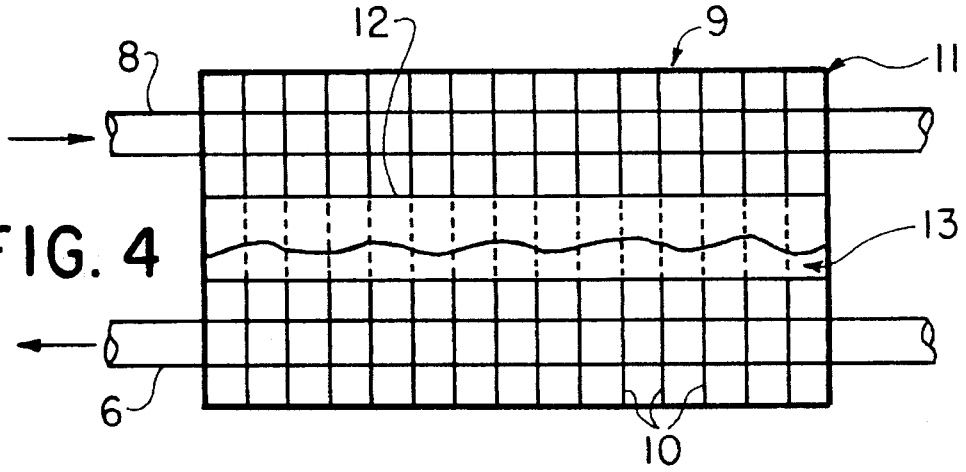
FIGS. 4 to 6 are longitudinal sectional views of three refinements of the heat exchanger.
Figure 5:
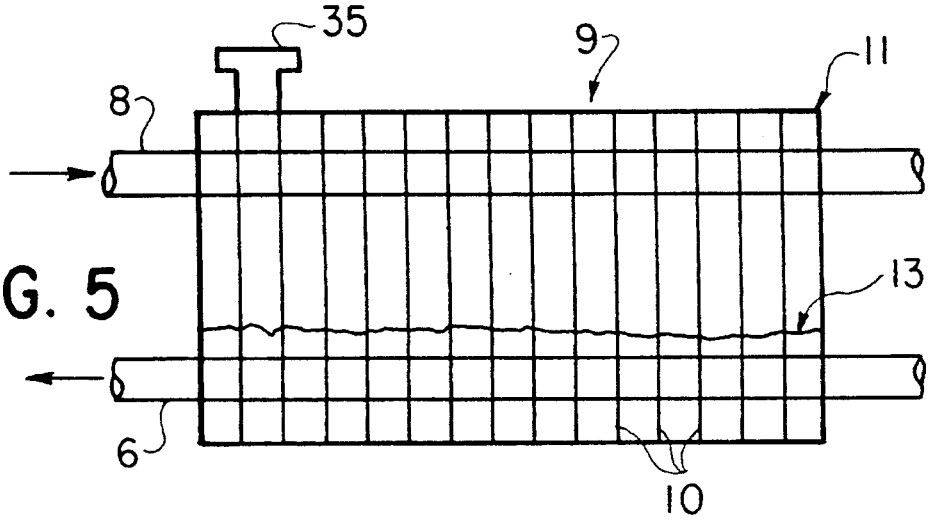
Figure 6:
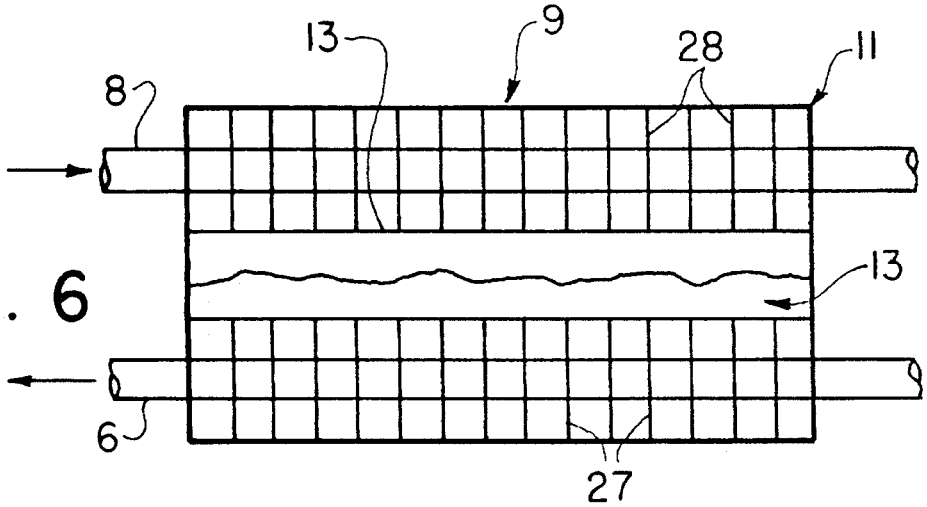

The heat exchangers 9 illustrated in FIGS. 4 to 6 differ from those in FIGS. 1 to 3 in that the ducts 6 and 8 are not interrupted, but pass through the housing 11, and in that the fins are disposed transversally to the flow of the fluid and also have ducts passing through them.

The refinement in FIG. 4 comprises a fluid tank 12 similar to that in FIGS. 1 and 2, which also passes through the fins of a single block 10 occupying the interior space of the housing 11. These fins ensure that transfer of heat between ducts 6 and 8, partly directly and partly by means of the fluid 13 contained in the tank 12.

In FIG. 5, the tank 12 is omitted and the fluid 13 is introduced directly into the housing 11, which for this purpose has a filler cap 35. The block of fins 10 is similar to that in FIG. 4, except that it does not have a recess for the passage of the tank 12. The fluid 13 is in direct contact with the fins and with ducts 6 and 8. The transfer of heat between these is ensured, directly and in parallel, by the fins and by the fluid 13.

Finally, the refinement in FIG. 6 differs from that in Figure 4 in that the fluid tank 12 occupies the entire width of the housing 11, thus separating the block of fins 10 into a lower block 27 ensuring the transfer of heat between duct 6 and the fluid 13, and an upper block 28 ensuring the transfer of heat between the fluid 13 and the duct 8.

Of course, the heat exchangers in FIGS. 4 to 6 may be equipped with a thermally insulating shell similar to that in FIGS. 2 and 3, and may form a rigid unit with an expansion valve as illustrated in FIG. 3. Furthermore, the housing 11 of the heat exchanger in FIG. 4 is used just to protect the block of fins, and may be omitted without detriment to the operation of the device.

What is claimed is:

1. A cooling fluid circuit comprising a compressor adapted to bring cooling fluid in vapor phase from a low pressure to a high pressure, a condenser adapted to bring high-pressure cooling fluid from the vapor phase to the liquid phase by yielding heat to an external medium, an expansion valve adapted to bring cooling fluid in liquid phase from high pressure to low pressure, an evaporator adapted to bring low-pressure cooling fluid from the liquid phase to the vapor phase by receiving heat from an external medium, and first, second, third and fourth ducts for transferring cooling fluid respectively from the compressor to the condenser, from the condenser to the expansion valve, from the expansion valve to the evaporator and from the evaporator to the compressor, a heat exchanger operable to transfer heat from the second duct to the fourth duct, outside the circuit, to condense residual vapor and to vaporize residual liquid which may be respectively located therein, said heat exchanger having a housing with a high-pressure chamber and a low-pressure chamber into which the second and fourth ducts respectively open, upstreams and downstreams, an said housing containing means for transmitting heat from one to the other by conducting and by convection, wherein said housing containing means have two blocks of fine disposed respectively in said chambers, the fine of each block extending the direction of flow of the cooling fluid in the corresponding chamber.

2. A cooling fluid circuit to claim 1, wherein each of the second and fourth ducts opens into two frees spaced of the corresponding chamber situated respectively upstream and downstream form the block of fins.

3. A cooling fluid circuit comprising a compressor adapted to bring cooling fluid in vapor phase from a low pressure to a high pressure, a condenser adapted to bring a high-pressure cooling fluid from the vapor phase to the liquid phase by yielding heat to an external medium, as expansion valve adapted to bring cooling fluid in liquid phase from high pressure to low pressure, an evaporator adapted to bring low-pressure cooling fluid from the liquid phase to the vapor phase by receiving heat from an external medium, and first, second, third and fourth ducts for transferring cooling fluid respectively from the compressor to the condenser, from the condenser to the expansion valve, from the expansion valve to the evaporator and from the evaporator to the compressor, a heat exchanger operable to transfer heat from the second duct to the fourth duct, outside the circuit, to condense residual vapor and to vaporize residual liquid which may be respectively located therein, said heat exchanger having a housing with a high-pressure chamber and a low-pressure chamber into which the second and fourth ducts respectively open, upstream and downstream, and said housing containing means for transmitting heat from one to the other by conducting and by convection, wherein said housing containing means have a tank containing a fluid which can pass from the liquid phase to the vapor phase, the tank being adjacent to the chambers and in thermal contact therewith.

4. A cooling fluid circuit comprising a compressor adapted to bring cooling fluid in vapor phase from a low pressure to a high pressure, a condenser adapted to bring high-pressure cooling fluid from the vapor phase to the liquid phase by yielding heat to an external medium, an expansion valve adapted to bring cooling fluid in liquid phase from high pressure to low pressure, an evaporator adapted to bring low-pressure cooling fluid from the liquid phase to the vapor phase by receiving heat from an external medium, and first, second, third and fourth ducts for transferring cooling fluid respectively from the compressor to the condenser, from the condenser to the expansion valve, from the expansion valve to the evaporator and from the evaporator to the compressor, a heat exchanger operable to transfer heat from the second duct to the fourth duct, outside the circuit, to condense residual vapor and to vaporize residual liquid which may be respectively located therein, said second and fourth ducts pass through the heat exchanger and said heat exchanger having means for transmitting heat from one duct to the other by conduction and convection, wherein said heat exchanger means have at least one block of fins, through the fins of which pass the second and fourth ducts with thermal contact.

5. A cooling fluid circuit according to claim 4, wherein said tank is in terminal contact with the ducts by means of at least one block of fins.

6. A cooling fluid circuit comprising a compressor adapted to bring cooling fluid in vapor phase from a low pressure to a high pressure, a condenser adapted to bring high-pressure cooling fluid from the vapor phase to the liquid phase by yielding heat to an external medium, an expansion valve adapted to bring cooling fluid in liquid phase from high pressure to low pressure, an evaporator adapted to bring low-pressure cooling fluid from the liquid phase to the vapor phase by receiving heat from an external medium, and first, second, third and fourth ducts for transferring cooling fluid respectively from the compressor to the condenser, from the condenser to the expansion valve, from the expansion valve to the evaporator and from the evaporator to the compressor, a heat exchanger operable to transfer heat from the second duct to the fourth duct, outside the circuit, to condense residue vapor and to vaporize residual liquid which may be respectively located therein, said second and fourth ducts pass through the heat exchanger and said heat exchanger having means for transmitting heat from one duct to the other by conduction and convection, wherein said means having a tank containing a fluid which can pass from the liquid phase to the vapor phase, the tank being in thermal contact with the second and fourth ducts.

7. A cooling fluid according to claim 6, wherein said the tank is formed by the housing, itself containing a single block of fins through which pass the two ducts and in contact with the fluid.

8. A cooling fluid circuit comprising a compressor adapted to bring cooling fluid in vapor phase from a low pressure to a high pressure, a condenser adapted to bring high-pressure cooling fluid from the vapor phase to the liquid phase by yielding heat to an external medium, an expansion valve adapted to bring cooling fluid in liquid phase from high pressure to low pressure, an evaporator adapted to bring low-pressure cooling fluid from the liquid phase to the vapor phase by receiving heat from an external medium, and first, second, third and fourth ducts for transferring cooling fluid respectively from the compressor to the condenser, from the condenser to the expansion valve, from the expansion valve to the evaporator and from the evaporator to the compressor, a heat exchanger operable to transfer that from the second duct to the fourth duct, outside the circuit, to condense residual vapor and to vaporize residual liquid which may be respectively located therein, said expansion valve is of the H-shaped monobloc type and said fourth duct passes through it upstream from the heat exchanger, and wherein said heat exchanger and said expansion valve form a rigid unit.

* * * * *

UNITED STATES PATENT AND TRADEMARK OFFICE

CERTIFICATE OF CORRECTION

PATENT NO. : 5,544,498

DATED : August 13, 1996

INVENTOR(S) : Olusegun O. Benedict

It is certified that error appears in the above-identified patent and that said Letters Patent is hereby corrected as shown below:

In Claim 1 at Column 4, line 42, delete [upstreams] and insert --upstream--;
same line, delete [downstreams'] and insert -- line 43, delete [an] and insert --and--;

line 46, delete [fine] and insert -- fins --;

line 47, after "extending" insert -- in -- ;

In Claim 2, at Column 4, line 50, delete [frees spaced] and insert -- free spaces -- ;
line 52, delete [form] and insert -- from -- ;

In Claim 3, at Column 4, line 55, delete [a] (third occurrence);

line 57, delete [as] and insert -- an -- ;

at Column 5, line 7, delete [conducting] and insert -- conduction -- ;

line 10, before "chambers" insert -- two -- ;

In Claim 8, at Column 5, line 36 delete [that] and insert -- heat --.

Signed and Sealed this

Twenty-first Day of December, 1999

*Attest:*

Q. TODD DICKINSON

*Attesting Officer*

*Acting Commissioner of Patents and Trademarks*